US010803852B2

(12) United States Patent
Yamamoto

(10) Patent No.: US 10,803,852 B2
(45) Date of Patent: Oct. 13, 2020

(54) SPEECH PROCESSING APPARATUS, SPEECH PROCESSING METHOD, AND COMPUTER PROGRAM PRODUCT

(71) Applicant: Kabushiki Kaisha Toshiba, Minato-ku, Tokyo (JP)

(72) Inventor: Masahiro Yamamoto, Kawasaki Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/688,617

(22) Filed: Aug. 28, 2017

(65) Prior Publication Data

US 2018/0277095 A1 Sep. 27, 2018

(30) Foreign Application Priority Data

Mar. 22, 2017 (JP) ..... 2017-056290

(51) Int. Cl.
*G10L 13/08* (2013.01)
*G10L 13/04* (2013.01)
(Continued)

(52) U.S. Cl.
CPC ..... *G10L 13/08* (2013.01); *G10L 13/033* (2013.01); *G10L 13/04* (2013.01); *G10L 13/10* (2013.01); *G10L 21/003* (2013.01)

(58) Field of Classification Search
CPC . H05K 999/99; G06F 17/289; G06F 17/2785; G10L 17/005; G10L 21/0208;
(Continued)

(56) References Cited

U.S. PATENT DOCUMENTS 5,113,449 A * 5/1992 Blanton ..... G10L 13/033 704/261
5,717,818 A * 2/1998 Nejime ..... G10L 21/04 381/23.1
(Continued)

FOREIGN PATENT DOCUMENTS

JP H10258688 A 9/1998
JP 2003-131700 A 5/2003
(Continued)

OTHER PUBLICATIONS

Carlyon, R. P., "How the Brain Separates Sounds", Trends in Cognitive Sciences, vol. 8 No. 10, Oct. 2004, 7 pgs.
(Continued)

*Primary Examiner* — Neeraj Sharma
(74) *Attorney, Agent, or Firm* — Knobbe, Martens, Olson & Bear, LLP

(57) ABSTRACT

A speech processing apparatus includes a specifier, a determiner, and a modulator. The specifier specifies an emphasis part of speech to be output. The determiner determines, from among a plurality of output units, a first output unit and a second output unit for outputting speech for emphasizing the emphasis part. The modulator modulates the emphasis part of at least one of first speech to be output to the first output unit and second speech to be output to the second output unit such that at least one of a pitch and a phase is different between the emphasis part of the first speech and the emphasis part of the second speech.

10 Claims, 13 Drawing Sheets

(51) Int. Cl.
*G10L 13/033* (2013.01)
*G10L 13/10* (2013.01)
*G10L 21/003* (2013.01)

(58) Field of Classification Search
CPC ..... G10L 13/08; G10L 15/22; G10L 15/187; G10L 15/20; G10L 15/265; G10L 15/02; G10L 25/90; G10L 21/04
See application file for complete search history.

(56) References Cited

U.S. PATENT DOCUMENTS 5,781,696 A * 7/1998 Oh ..... G10L 21/01 704/206
5,991,724 A * 11/1999 Kojima ..... G10L 21/04 704/266
6,125,344 A * 9/2000 Kang ..... G10L 21/003 704/201
6,385,581 B1 * 5/2002 Stephenson ..... H04M 3/56 704/258
6,556,972 B1 * 4/2003 Bakis ..... G06F 17/289 704/2
6,859,778 B1 * 2/2005 Bakis ..... G06F 17/289 704/2
7,401,021 B2 7/2008 Choi
8,175,879 B2 * 5/2012 Nitisaroj ..... G10L 15/1807 704/251
8,364,484 B2 1/2013 Yano et al.
8,798,995 B1 * 8/2014 Edara ..... G06Q 30/0255 704/246
9,691,387 B2 * 6/2017 Nakadai ..... G06F 17/275
9,706,299 B2 * 7/2017 Talwar ..... H04R 3/005
9,854,324 B1 * 12/2017 Panchaksharaiah ..... H04N 21/4884
9,870,779 B2 * 1/2018 Tachibana ..... G10L 13/02
9,922,662 B2 * 3/2018 Sorin ..... G10L 21/003
9,961,435 B1 * 5/2018 Goyal ..... H04R 1/1083
2001/0044721 A1 * 11/2001 Yoshioka ..... G10L 19/18 704/258
2002/0128841 A1 * 9/2002 Kibre ..... G10L 13/10 704/260
2003/0036903 A1 2/2003 Konopka et al.
2003/0088397 A1 5/2003 Karas et al.
2003/0185411 A1 * 10/2003 Atlas ..... G10L 21/0208 381/98
2004/0062363 A1 4/2004 Shambaugh
2004/0075677 A1 * 4/2004 Loyall ..... G06F 3/011 715/706
2004/0143433 A1 * 7/2004 Marumoto ..... H03G 3/32 704/225
2005/0060142 A1 * 3/2005 Visser ..... G10L 21/0208 704/201
2005/0075877 A1 4/2005 Minamino et al.
2005/0171778 A1 * 8/2005 Sasaki ..... G10L 13/08 704/269
2005/0187762 A1 * 8/2005 Tanaka ..... G10L 19/26 704/220
2005/0261905 A1 11/2005 Pyo et al.
2006/0161430 A1 * 7/2006 Schweng ..... G10L 25/78 704/233
2006/0206320 A1 * 9/2006 Li ..... G10L 21/0208 704/226
2006/0255993 A1 * 11/2006 Miki ..... H04R 3/12 341/143
2007/0021958 A1 * 1/2007 Visser ..... G10L 21/0272 704/226
2007/0172076 A1 * 7/2007 Mori ..... H04R 3/12 381/77
2007/0202481 A1 8/2007 Smith Lewis et al.
2007/0233469 A1 * 10/2007 Chen ..... G10L 25/69 704/207
2007/0271516 A1 * 11/2007 Carmichael ..... G06F 3/04817 715/738
2007/0299657 A1 * 12/2007 Kang ..... G10L 19/008 704/207
2008/0069366 A1 * 3/2008 Soulodre ..... G01H 7/00 381/63
2008/0243474 A1 * 10/2008 Furihata ..... G06F 17/289 704/2
2008/0270138 A1 10/2008 Knight et al.
2008/0270344 A1 10/2008 Yurick et al.
2008/0294429 A1 * 11/2008 Su ..... G10L 19/09 704/222
2009/0012794 A1 * 1/2009 van Wijngaarden ... G10L 25/48 704/270
2009/0055188 A1 * 2/2009 Hirabayashi ..... G10L 13/10 704/260
2009/0106021 A1 * 4/2009 Zurek ..... G10L 21/0208 704/226
2009/0150151 A1 * 6/2009 Sakuraba ..... G10L 21/028 704/246
2009/0248409 A1 * 10/2009 Endo ..... H03G 3/32 704/226
2009/0319270 A1 12/2009 Gross
2010/0066742 A1 * 3/2010 Qian ..... G10L 13/10 345/440.1
2011/0029301 A1 2/2011 Han et al.
2011/0102619 A1 * 5/2011 Niinami ..... H04N 5/232 348/222.1
2011/0125493 A1 * 5/2011 Hirose ..... G10L 21/003 704/207
2011/0313762 A1 * 12/2011 Ben-David ..... G10L 13/08 704/231
2012/0065962 A1 * 3/2012 Lowles ..... G06F 1/1626 704/9
2012/0066231 A1 3/2012 Petersen et al.
2012/0201386 A1 * 8/2012 Riedmiller ..... G10L 19/008 381/2
2012/0296642 A1 11/2012 Shammass et al.
2013/0073283 A1 * 3/2013 Yamabe ..... G10L 21/0216 704/226
2013/0151243 A1 * 6/2013 Kim ..... G10L 21/003 704/201
2013/0218568 A1 * 8/2013 Tamura ..... G10L 13/033 704/260
2013/0337796 A1 * 12/2013 Suhami ..... H04R 25/00 455/422.1
2014/0108011 A1 * 4/2014 Nishino ..... G10L 25/51 704/246
2014/0156270 A1 * 6/2014 Shin ..... G10L 21/0216 704/231
2014/0214418 A1 * 7/2014 Nakadai ..... G10L 21/0216 704/233
2014/0293748 A1 * 10/2014 Altman ..... G01S 3/8083 367/127
2015/0012269 A1 * 1/2015 Nakadai ..... G10L 21/0208 704/233
2015/0106087 A1 * 4/2015 Newman ..... G10L 25/78 704/233
2015/0154957 A1 * 6/2015 Nakadai ..... G06F 17/275 704/235
2015/0325232 A1 * 11/2015 Tachibana ..... G10L 13/02 704/268
2015/0350621 A1 * 12/2015 Sawa ..... H04N 5/93 386/201
2016/0005394 A1 * 1/2016 Hiroe ..... G10L 15/04 704/248
2016/0088438 A1 * 3/2016 O'Keeffe ..... H04W 4/21 455/456.2
2016/0125882 A1 * 5/2016 Contolini ..... H04R 1/08 704/231
2016/0203828 A1 * 7/2016 Gomez ..... G10L 15/20 704/226
2016/0217171 A1 * 7/2016 Arngren ..... G06F 17/3082
2016/0247520 A1 * 8/2016 Kikugawa ..... G10L 15/26
2016/0275936 A1 * 9/2016 Thorn ..... G10L 13/08
2017/0148464 A1 * 5/2017 Zhang ..... G10L 21/013
2017/0162010 A1 * 6/2017 Cruz-Hernandez ..... G08B 6/00
2017/0243582 A1 * 8/2017 Menezes ..... G10L 13/0335

(56) References Cited

U.S. PATENT DOCUMENTS

| | | | | |
|---|---|---|---|---|
| 2017/0277672 | A1* | 9/2017 | Cho | G06F 3/04845 |
| 2017/0309271 | A1 | 10/2017 | Chiang | |
| 2018/0020285 | A1* | 1/2018 | Zass | G16H 50/70 |
| 2018/0070175 | A1* | 3/2018 | Obata | H04R 3/04 |
| 2018/0130459 | A1* | 5/2018 | Paradiso | G10L 13/04 |
| 2018/0146289 | A1* | 5/2018 | Namm | H04R 3/12 |
| 2018/0285312 | A1* | 10/2018 | Liu | G06Q 50/01 |

FOREIGN PATENT DOCUMENTS

| | | | |
|---|---|---|---|
| JP | 2005-306231 | A | 11/2005 |
| JP | 2007-019980 | A | 1/2007 |
| JP | 2007-257341 | A | 10/2007 |
| JP | 2007-334919 | A | 12/2007 |
| JP | 2016-080894 | A | 5/2016 |
| JP | 2016-134662 | A | 7/2016 |
| JP | 2018-036527 | A | 3/2018 |

OTHER PUBLICATIONS

Office Action issued in Japanese application No. 2017-056290 dated Sep. 3, 2019.

Office Action issued in Japanese application No. 2017-056168 dated Sep. 3, 2019.

* cited by examiner

SPEECH PROCESSING APPARATUS, SPEECH PROCESSING METHOD, AND COMPUTER PROGRAM PRODUCT

CROSS-REFERENCE TO RELATED APPLICATIONS

This application is based upon and claims the benefit of priority from Japanese Patent Application No. 2017-056290, filed on Mar. 22, 2017; the entire contents of which are incorporated herein by reference.

FIELD

Embodiments described herein relate generally to a speech processing apparatus, a speech processing method, and a computer program product.

BACKGROUND

It is very important to transmit appropriate messages in everyday environments. In particular, attention drawing and danger notification in car navigation systems and messages in emergency broadcasting that should be notified without being buried in ambient environmental sound are required to be delivered without fail in consideration of subsequent actions.

Examples of commonly used methods for the attention drawing and the danger notification in car navigation systems include stimulation with light, and addition of buzzer sound.

In the conventional techniques, however, attention drawing is made by stimulation that is increased larger than that of the normal speech guidance, thus surprising a user such as a driver at the moment of the attention drawing. The actions of surprised users tend to be delayed, and the stimulation, which should prompt smooth crisis prevention actions, can lead to the restriction of actions.

DETAILED DESCRIPTION

According to one embodiment, a speech processing apparatus includes a specifier, a determiner, and a modulator. The specifier specifies an emphasis part of speech to be output. The determiner determines, from among a plurality of output units, a first output unit and a second output unit for outputting speech for emphasizing the emphasis part. The modulator modulates the emphasis part of at least one of first speech to be output to the first output unit and second speech to be output to the second output unit such that at least one of a pitch and a phase is different between the emphasis part of the first speech and the emphasis part of the second speech.

Referring to the accompanying drawings, a speech processing apparatus according to exemplary embodiments is described in detail below.

Experiments by the inventor made it clear that when a user hears speeches in which at least one of the pitch and the phase is different from one speech to another from a plurality of speech output devices (such as speakers and headphones), the clarity by perception increases and the level of attention increases regardless of the physical magnitude (loudness) of speech. The sense of surprise was hardly observed in this case.

It has been believed that audibility degrades because clarity is reduced in listening of speeches from sound output devices having different pitches or different phases. However, the experiments by the inventor made it clear that when a user hears speeches in which at least one of the pitch and the phase is different from one speech to another with right and left ears, the clarity increases and the level of attention increases.

This reveals that a cognitive function of hearing acts to perceive speech more clearly by using both ears. The following embodiments are and enable attention drawing and danger alert by utilizing an increase in perception obtained by speeches in which at least one of the pitch and the phase is different from one speech to another to right and left ears.

First Embodiment

A speech processing apparatus according to a first embodiment modulates at least one of a pitch and a phase of the speech corresponding to an emphasis part, and outputs the modulated speech. In this manner, users' attention can be enhanced to allow a user to smoothly do the next action without changing the intensity of speech signals.

Figure 1:
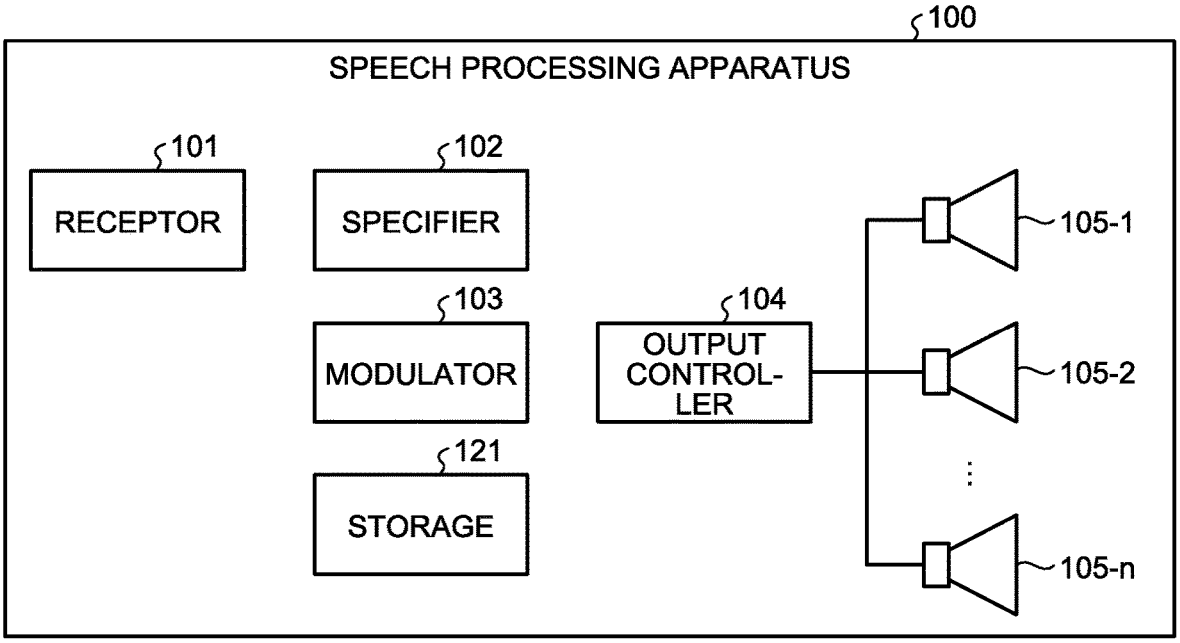
FIG. 1 is a block diagram of a speech processing apparatus according to a first embodiment.

FIG. 1 is a block diagram illustrating an example of a configuration of a speech processing apparatus 100 according to the first embodiment. As illustrated in FIG. 1, the speech processing apparatus 100 includes a storage 121, a receptor 101, a specifier 102, a modulator 103, an output controller 104, and speakers 105-1 to **105-*n*** (n is an integer of 2 or more).

The storage 121 stores therein various kinds of data used by the speech processing apparatus 100. For example, the storage 121 stores therein input text data and data indicating an emphasis part specified from text data. The storage 121 can be configured by any commonly used storage medium, such as a hard disk drive (HDD), a solid-state drive (SSD), an optical disc, a memory card, and a random access memory (RAM).

The speakers 105-1 to **105-*n* are output units configured to output speech in accordance with an instruction from the output controller 104. The speakers 105-1 to 105-*n* have similar configurations, and are sometimes referred to simply as "speakers 105" unless otherwise distinguished. The following description exemplifies a case of modulating at least one of the pitch and the phase of speech to be output to a pair of two speakers, the speaker 105-1 (first output unit) and the speaker 105-2** (second output unit). Similar processing may be applied to two or more sets of speakers.

The receptor 101 receives various kinds of data to be processed. For example, the receptor 101 receives an input of text data that is converted into the speech to be output.

The specifier 102 specifies an emphasis part of speech to be output, which indicates a part that is emphasized and output. The emphasis part corresponds to a part to be output such that at least one of the pitch and the phase is modulated in order to draw attention and notify dangers. For example, the specifier 102 specifies an emphasis part from input text data. When information for specifying an emphasis part is added to input text data in advance, the specifier 102 can specify the emphasis part by referring to the added information (additional information). The specifier 102 may specify the emphasis part by collating the text data with data indicating a predetermined emphasis part. The specifier 102 may execute both of the specification by the additional information and the specification by the data collation. Data indicating an emphasis part may be stored in the storage 121, or may be stored in a storage device outside the speech processing apparatus 100.

The specifier 102 may execute encoding processing for adding information (additional information) to the text data, the information indicating that the specified emphasis part is emphasized. The subsequent modulator 103 can determine the emphasis part to be modulated by referring to the thus added additional information. The additional information may be in any form as long as an emphasis part can be determined with the information. The specifier 102 may store the encoded text data in a storage medium, such as the storage 121. Consequently, text data that is added with additional information in advance can be used in subsequent speech output processing.

The modulator 103 modulates at least one of the pitch and the phase of speech to be output as the modulation target. For example, the modulator 103 modulates a modulation target of an emphasis part, of at least one of speech (first speech) to be output to the speaker 105-1 and speech (second speech) to be output to the speaker 105-2 such that the modulation target of the emphasis part of the first speech and the modulation target of the emphasis part of the second speech are different.

In the first embodiment, when generating speeches converted from text data, the modulator 103 sequentially determines whether the text data is an emphasis part, and executes modulation processing on the emphasis part. Specifically, in the case of converting text data to generate speech (first speech) to be output to the speaker 105-1 and speech (second speech) to be output to the speaker 105-2, the modulator 103 generates the first speech and the second speech in which a modulation target of at least one of the first speech and the second speech is modulated such that modulation targets are different from each other for text data of the emphasis part.

The processing of converting text data into speech (speech synthesis processing) may be implemented by using any conventional method such as formant speech synthesis and speech corpus-based speech synthesis.

For the modulation of the phase, the modulator 103 may reverse the polarity of a signal input to one of the speaker 105-1 and the speaker 105-2. In this manner, one of the speakers 105 is in antiphase to the other, and the same function as that when the phase of speech data is modulated can be implemented.

The modulator 103 may check the integrity of data to be processed, and perform the modulation processing when the integrity is confirmed. For example, when additional information added to text data is in a form that designates information indicating the start of an emphasis part and information indicating the end of the emphasis part, the modulator 103 may perform the modulation processing when it can be confirmed that the information indicating the start and the information indicating the end correspond to each other.

The output controller 104 controls the output of speech from the speakers 105. For example, the output controller 104 controls the speaker 105-1 to output first speech the modulation target of which has been modulated, and controls the speaker 105-2 to output second speech. When the speakers 105 other than the speaker 105-1 and the speaker 105-2 are installed, the output controller 104 allocates optimum speech to each speaker 105 to be output. Each speaker 105 outputs speech on the basis of output data from the output controller 104.

The output controller 104 uses parameters such as the position and characteristics of the speaker 105 to calculate the output (amplifier output) to each speaker 105. The parameters are stored in, for example, the storage 121.

For example, in the case of matching required sound pressures for two speakers 105, amplifier outputs W1 and W2 for the respective speakers are calculated as follows. Distances associated with the two speakers are represented by L1 and L2. For example, L1 (L2) is the distance between the speaker 105-1 (speaker 105-2) and the center of the head of a user. The distance between each speaker 105 and the closest ear may be used. The gain of the speaker 105-1 (speaker 105-2) in an audible region of speech in use is represented by Gs1 (Gs2). The gain reduces by 6 dB when the distance is doubled, and the amplifier output needs to be doubled for an increase in sound pressure of 3 dB. In order to match the sound pressures between both ears, the output controller 104 calculates and determines the amplifier outputs W1 and W2 so as to satisfy the following equation:

$$-6\times(L1/L2)\times(1/2)+(2/3)\times Gs1\times W1=-6\times(L2/L1)\times(1/2)+(2/3)\times Gs2\times W2$$

The receptor 101, the specifier 102, the modulator 103, and the output controller 104 may be implemented by, for example, causing one or more processors such as central processing units (CPUs) to execute programs, that is, by software, may be implemented by one or more processors such as integrated circuits (ICs), that is, by hardware, or may be implemented by a combination of software and hardware.

Figure 2:
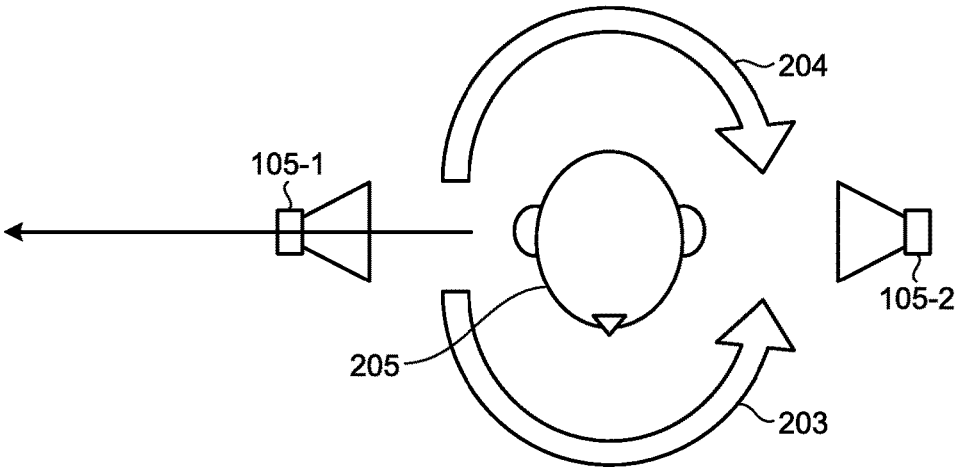
FIG. 2 is a diagram illustrating an example of arrangement of speakers in embodiments.

FIG. 2 is a diagram illustrating an example of the arrangement of speakers 105 in the first embodiment. FIG. 2 illustrates an example of the arrangement of speakers 105 as observed from above a user 205 to below in the vertical direction. Speeches that have been subjected to the modulation processing by the modulator 103 are output from a speaker 105-1 and a speaker 105-2. The speaker 105-1 is placed on an extension line from the right ear of the user 205. The speaker 105-2 can be placed an angle with respect to a line passing through the speaker 105-1 and the right ear.

The inventor measured attention obtained when speech the pitch and phase of which are modulated is output while the position of the speaker 105-2 is changed along a curve 203 or a curve 204, and confirmed an increase of the attention in each case. The attention was measured by using evaluation criterion such as electroencephalogram (EEG), near-infrared spectroscopy (NIRS), and subjective evaluation.

Figure 3:
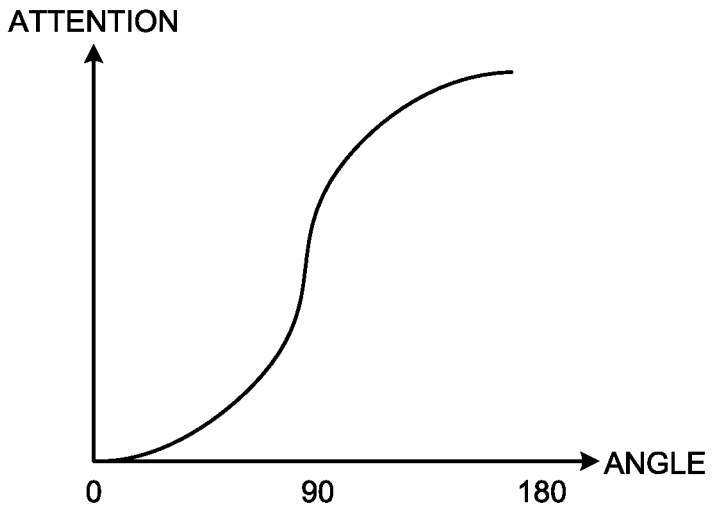
FIG. 3 is a diagram illustrating an example of measurement results.

FIG. 3 is a diagram illustrating an example of measurement results. The horizontal axis of the graph in FIG. 3 represents an arrangement angle of the speakers 105. For example, the arrangement angle is an angle formed by a line connecting the speaker 105-1 and the user 205 and a line connecting the speaker 105-2 and the user 205. As illustrated in FIG. 3, the attention increases greatly when the arrangement angle is from 90° to 180°. It is therefore desired that the speaker 105-1 and the speaker 105-2 be arranged to have an arrangement angle of from 90° to 180°. Note that the arrangement angle may be smaller than 90° as long as the arrangement angle is larger than 0° because the attention is detected.

The pitch or phase in the whole section of speech may be modulated, but in this case, attention can be reduced because of being accustomed. Thus, the modulator 103 modulates only an emphasis part specified by, for example, additional information. Consequently, attention to the emphasis part can be effectively enhanced.

Figure 4:
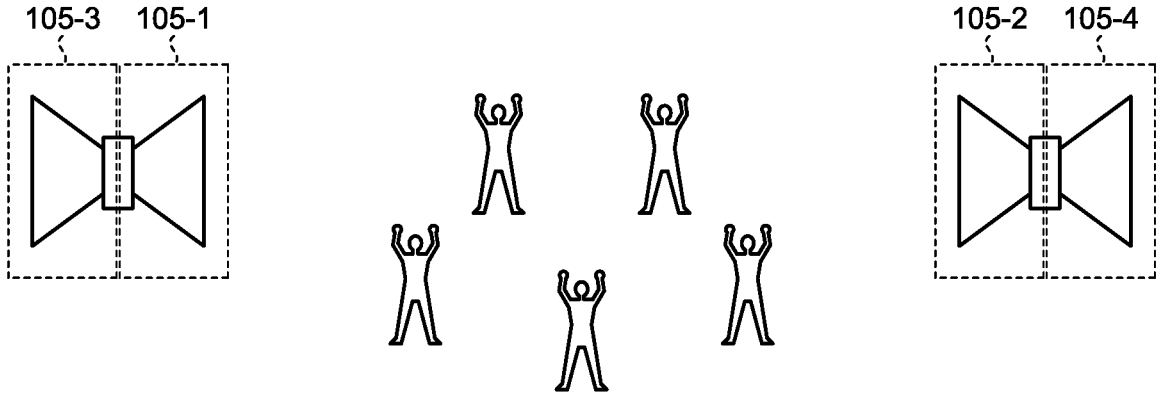
FIG. 4 a diagram illustrating another example of the arrangement of the speakers in the embodiments.

FIG. 4 is a diagram illustrating another example of the arrangement of speakers 105 in the first embodiment. FIG. 4 illustrates an example of the arrangement of speakers 105 that are installed to output outdoor broadcasting outdoors. As illustrated in FIG. 3, it is desired to use a pair of speakers 105 having an arrangement angle of from 90° to 180°. Thus, in the example in FIG. 4, the modulation processing of speech is executed for a pair of a speaker 105-1 and a speaker 105-2 arranged at an arrangement angle of 180°.

Figure 5:
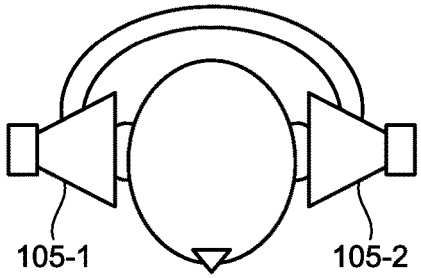
FIG. 5 is a diagram illustrating another example of the arrangement of the speakers in the embodiments.

FIG. 5 a diagram illustrating another example of the arrangement of speakers 105 in the first embodiment. FIG. 5 is an example where the speaker 105-1 and the speaker 105-2 are configured as headphones.

The arrangement examples of the speakers 105 are not limited to FIG. 2, FIG. 4, and FIG. 5. Any combination of speakers can be employed as long as the speakers are arranged at an arrangement angle that obtains attention as illustrated in FIG. 3. For example, the first embodiment may be applied to a plurality of speakers used for a car navigation system.

Figure 6:
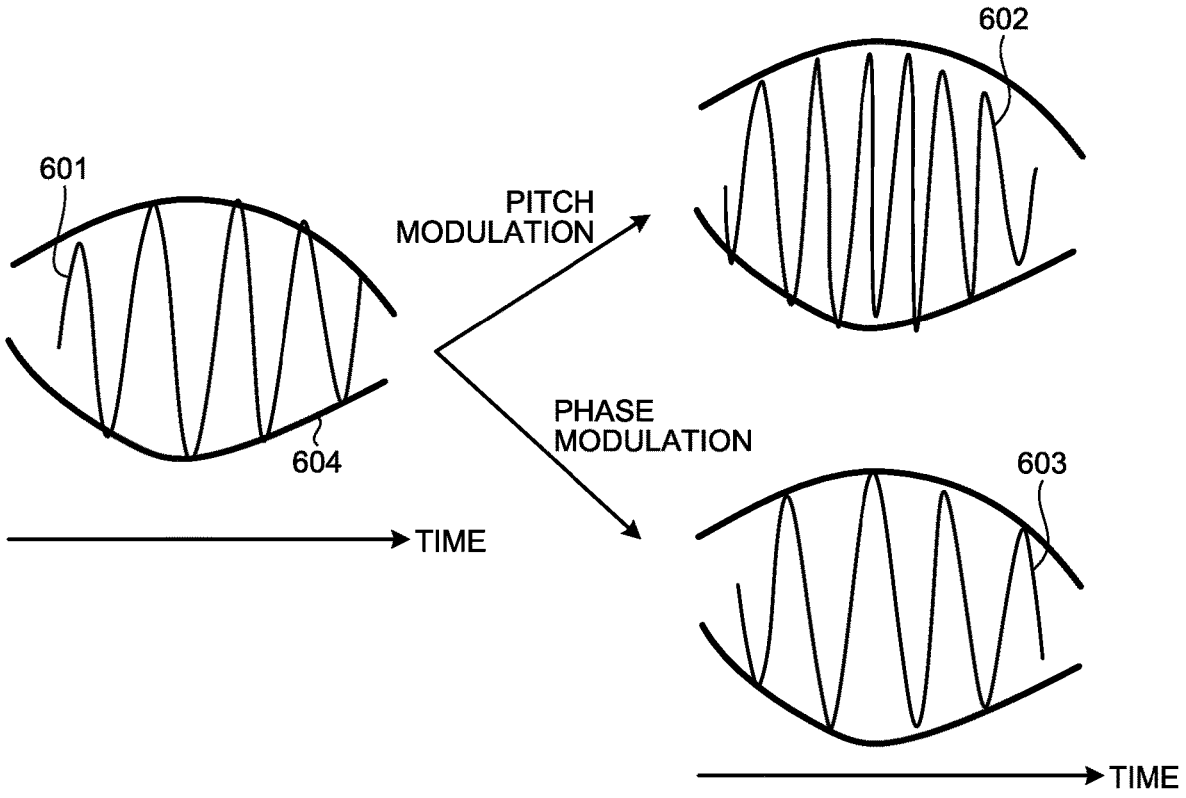
FIG. 6 is a diagram for describing pitch modulation and phase modulation.

Next, pitch modulation and phase modulation are described. FIG. 6 is a diagram for describing the pitch modulation and the phase modulation. The phase modulation involves outputting a signal 603 obtained by changing, on the basis of an envelope 604 of speech, temporal positions of peaks in its original signal 601 without changing the wavenumber in a unit time with respect to the same envelope. The pitch modulation involves outputting a signal 602 obtained by changing the wavenumber.

Figure 7:
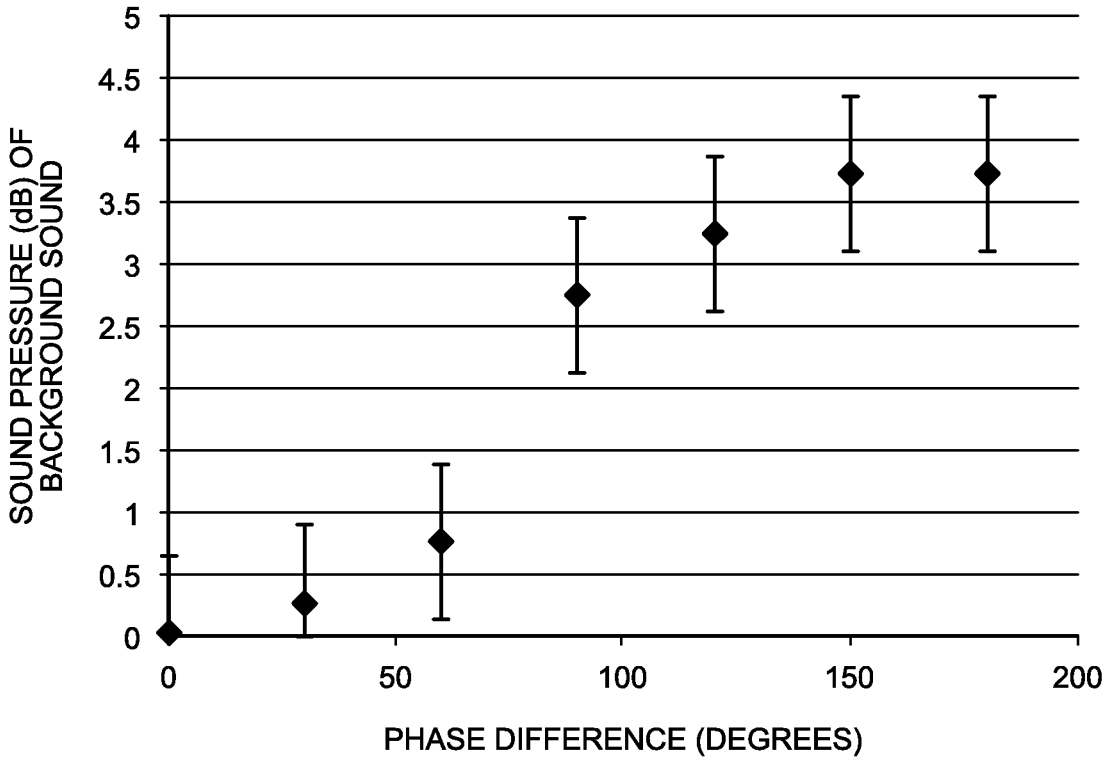
FIG. 7 is a diagram illustrating a relation between a phase difference (degrees) and a sound pressure (dB) of background sound.

Next, the relation between the pitch or phase modulation and the audibility of speech is described. FIG. 7 is a diagram illustrating a relation between a phase difference (degrees) and a sound pressure (dB) of background sound. The phase difference represents a difference in phase between speeches output from two speakers 105 (for example, a difference between the phase of the speech output from the speaker 105-1 and the phase of the speech output from the speaker 105-2). The sound pressure of background sound represents a maximum value of sound pressure (sound pressure limit) of background sound with which the user can hear output speech.

The background sound is sound other than speeches output from the speakers 105. For example, the background sound corresponds to ambient noise, sound such as music being output other than speeches, and the like. Points indicated by rectangles in FIG. 7 each represent an average value of obtained values. The range indicated by the vertical line on each point represents a standard deviation of the obtained values.

As illustrated in FIG. 7, even when background sound of 0.5 dB or more is present, the user can hear speeches output from the speaker 105 as long as the phase difference is 60° or more and 180° or less. Thus, the modulator 103 may execute the modulation processing such that the phase difference is 60° or more and 180° or less. The modulator 103 may execute the modulation processing so as to obtain a phase difference of 90° or more and 180° or less, or 120° or more and 180° or less, with which the sound pressure limit is higher.

Figure 8:
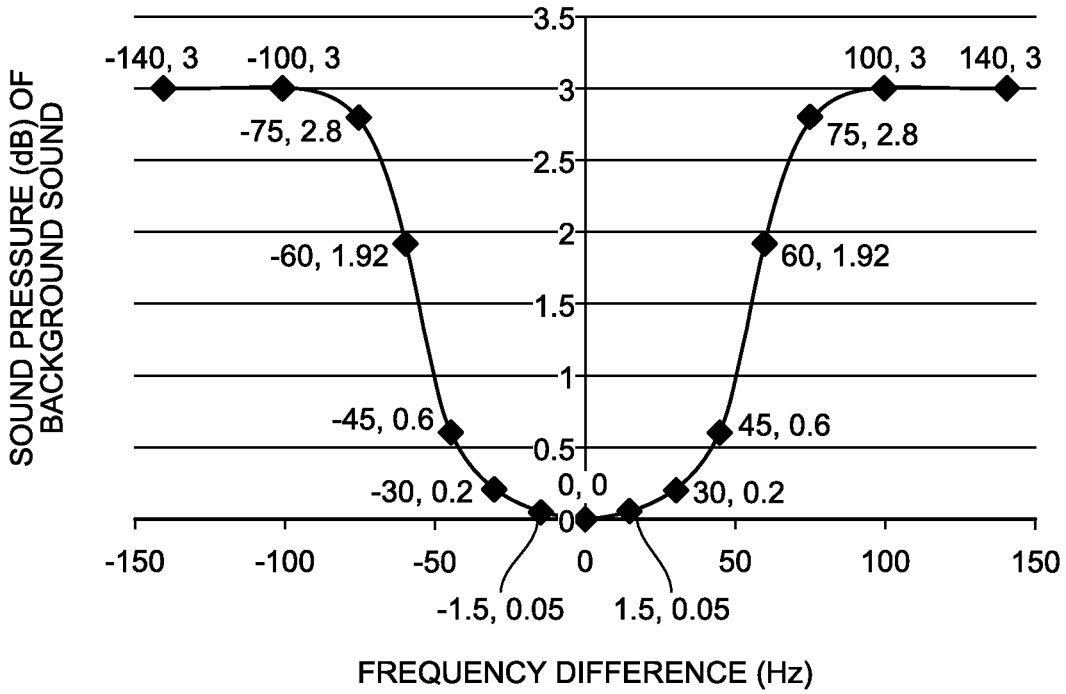
FIG. 8 is a diagram illustrating a relation between a frequency difference (Hz) and a sound pressure (dB) of background sound.

FIG. 8 is a diagram illustrating a relation between a frequency difference (Hz) and the sound pressure (dB) of background sound. The frequency difference represents a difference in frequency between speeches output from two speakers 105 (for example, a difference between the frequency of a speech output from the speaker 105-1 and the frequency of a speech output from the speaker 105-2). Points indicated bv rectangles in FIG. 8 each represent an average value of obtained values. Of numerical values "A, B" attached to the side of the points, "A" represents the frequency difference, and "B" represents the sound pressure of background sound.

As illustrated in FIG. 8, even when background sound is present, the user can hear speeches output from the speakers 105 as long as the frequency difference is 100 Hz (hertz) or more. Thus, the modulator 103 may execute the modulation processing such that the frequency difference is 100 Hz or more in the audible range.

Figure 9:
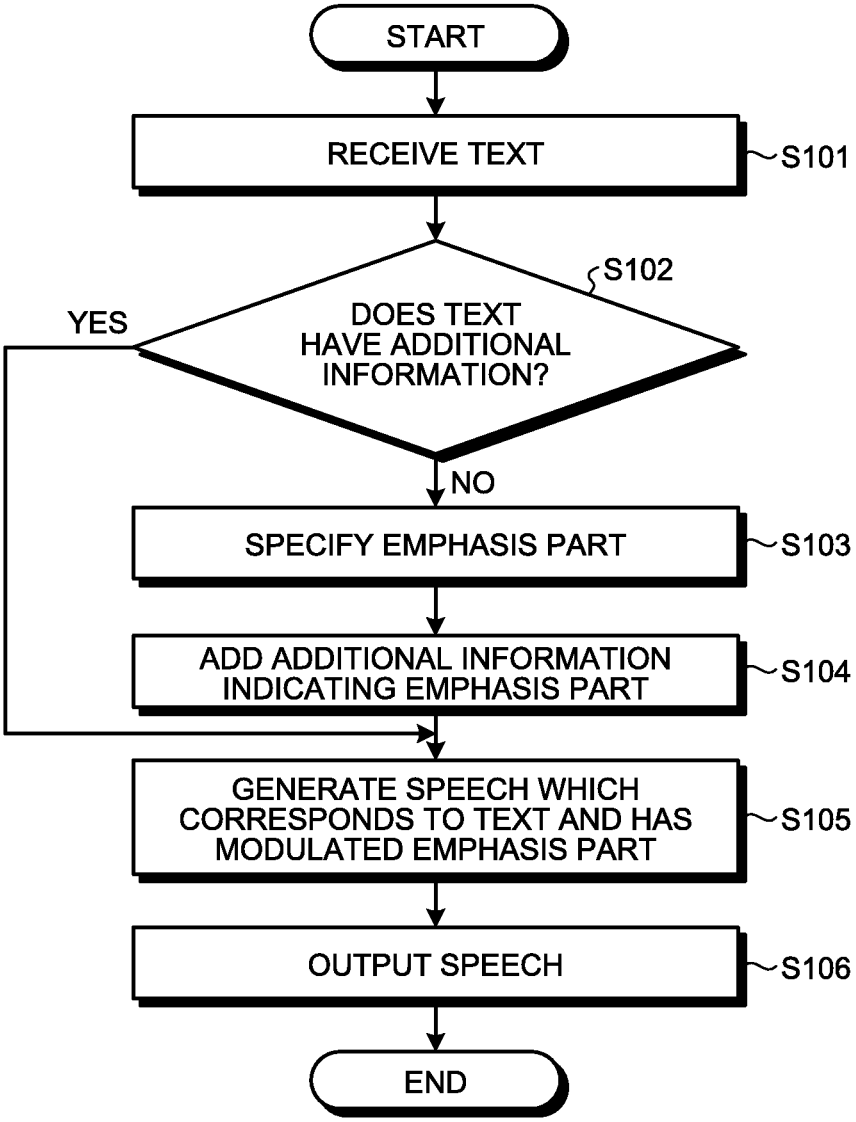
FIG. 9 a flowchart of the speech output processing according to the first embodiment.

Next, the speech output processing by the speech processing apparatus 100 according to the first embodiment configured as described above is described with reference to FIG. 9. FIG. 9 is a flowchart illustrating an example of the speech output processing in the first embodiment.

The receptor 101 receives an input of text data (Step S101). The specifier 102 determines whether additional information is added to the text data (Step S102). When additional information is not added to the text data (No at Step S102), the specifier 102 specifies an emphasis part from the text data (Step S103). For example, the specifier 102 specifies an emphasis part by collating the input text data with data indicating a predetermined emphasis part. The specifier 102 adds additional information indicating the emphasis part to a corresponding emphasis part of the text data (Step S104). Any method of adding the additional information can be employed as long as the modulator 103 can specify the emphasis part.

After the additional information is added (Step S104) or when additional information has been added to the text data (Yes at Step S102), the modulator 103 generates speeches (first speech and second speech) corresponding to the text data, the modulation targets of which are modulated such that the modulation targets are different for text data for the emphasis part. (Step S105).

The output controller 104 determines a speech to be output for each speaker 105 so as to output the determined speech (Step S106). Each speaker 105 outputs the speech in accordance with the instruction from the output controller 104.

In this manner, the speech processing apparatus according to the first embodiment is configured to modulate, while generating the speech corresponding to text data, at least one of the pitch and the phase of speech for text data corresponding to an emphasis part, and output the modulated speech. Consequently, users' attention can be enhanced without changing the intensity of speech signals.

Second Embodiment

In the first embodiment, when text data are sequentially converted into speech, the modulation processing is performed on text data on an emphasis part. A speech processing apparatus according to a second embodiment is configured to generate speech for text data and thereafter perform the modulation processing on the speech corresponding to an emphasis part of the generated speech.

Figure 10:
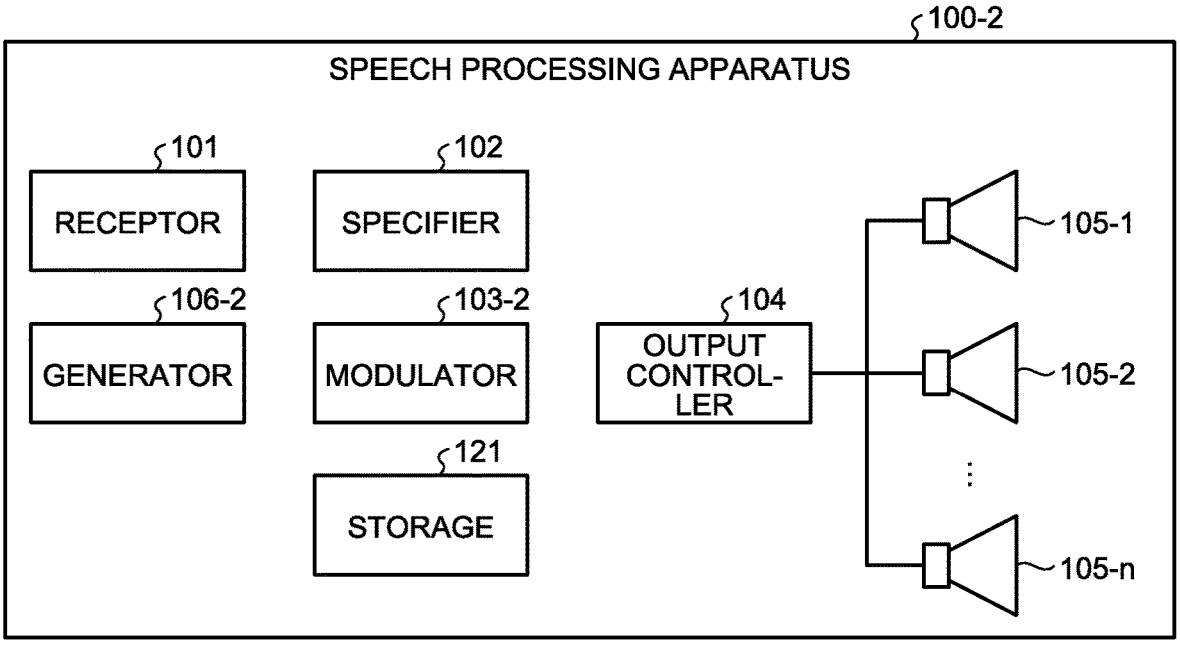
FIG. 10 is a block diagram of a speech processing apparatus according to a second embodiment.

FIG. 10 is a block diagram illustrating an example of a configuration of a speech processing apparatus 100-2 according to the second embodiment. As illustrated in FIG. 10, the speech processing apparatus 100-2 includes a storage 121, a receptor 101, a specifier 102, a modulator 103-2, an output controller 104, the speakers 105-1 to **105-*n*, and a generator 106-2**.

The second embodiment differs from the first embodiment in that the function of the modulator 103-2 and the generator 106-2 are added. Other configurations and functions are the same as those in FIG. 1, which is a block diagram of the speech processing apparatus 100 according to the first embodiment, and are therefore denoted by the same reference symbols to omit descriptions thereof.

The generator 106-2 generates the speech corresponding to text data. For example, the generator 106-2 converts the input text data into the speech (first speech) to be output to the speaker 105-1 and the speech (second speech) to be output to the speaker 105-2.

The modulator 103-2 performs the modulation processing on an emphasis part of the speech generated by the generator 106-2. For example, the modulator 103-2 modulates a modulation target of an emphasis part of at least one of the first speech and the second speech such that modulation targets are different between an emphasis part of the generated first speech and an emphasis part of the generated second speech.

Figure 11:
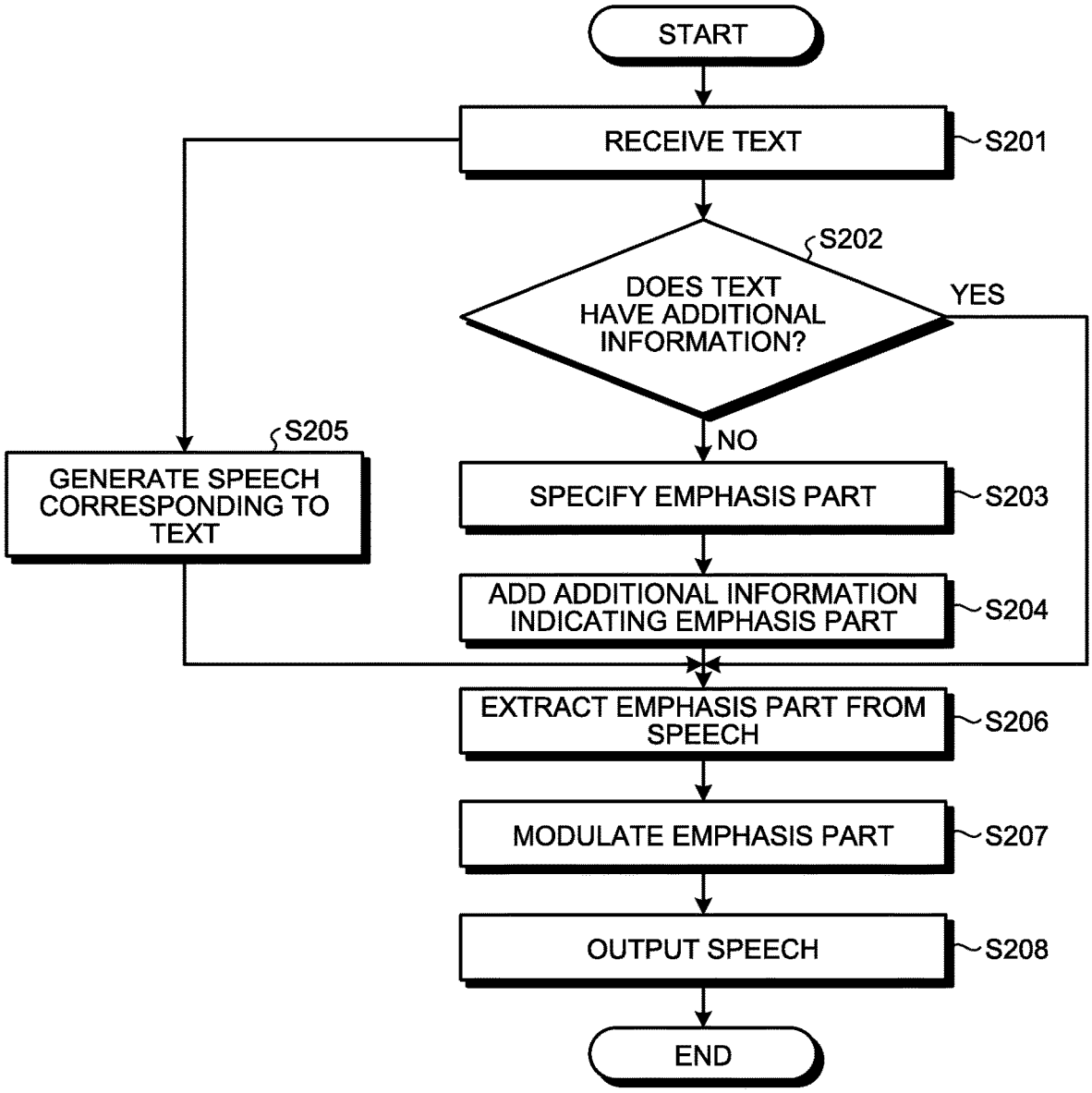
FIG. 11 as a flowchart of the speech output processing according to the second embodiment.

Next, the speech output processing by the speech processing apparatus 100-2 according to the second embodiment configured as described above is described with reference to FIG. 11. FIG. 11 is a flowchart illustrating an example of the speech output processing in the second embodiment.

Step S201 to Step S204 are processing similar to those at Step S101 to Step S104 in the speech processing apparatus 100 according to the first embodiment, and hence descriptions thereof are omitted.

In the second embodiment, when text data is input, speech generation processing (speech synthesis processing) is executed by the generator 106-2. Specifically, the generator 106-2 generates the speech corresponding to the text data (Step S205).

After the speech is generated (Step S205), after additional information is added (Step S204), or when additional information has been added to text data (Yes at Step S202), the modulator 103-2 extracts an emphasis part from the generated speech (Step S206). For example, the modulator 103-2 refers to the additional information to specify an emphasis part in the text data, and extracts an emphasis part of the speech corresponding to the specified emphasis part of the text data on the basis of the correspondence between the text data and the generated speech. The modulator 103-2 executes the modulation processing on the extracted emphasis part of the speech (Step S207). Note that the modulator 103-2 does not execute the modulation processing on the parts of the speech excluding the emphasis part.

Step S208 is processing similar to that at Step S106 in the speech processing apparatus 100 according to the first embodiment, and hence a description thereof is omitted.

In this manner, the speech processing apparatus according to the second embodiment is configured to, after generating the speech corresponding to text data, modulate at least one of the pitch and phase of the emphasis part of the speech, and output the modulated speech. Consequently, users' attention can be enhanced without changing the intensity of speech signals.

Third Embodiment

In the first and second embodiments, text data is input, and the input text data is converted into a speech to be output. These embodiments can be applied to, for example, the case where predetermined text data for emergency broadcasting is output. Another conceivable situation is that speech uttered by a user is output for emergency broadcasting. A speech processing apparatus according to a third embodiment is configured such that speech is input from a speech input device, such as a microphone, and an emphasis part of the input speech is subjected to the modulation processing.

Figure 12:
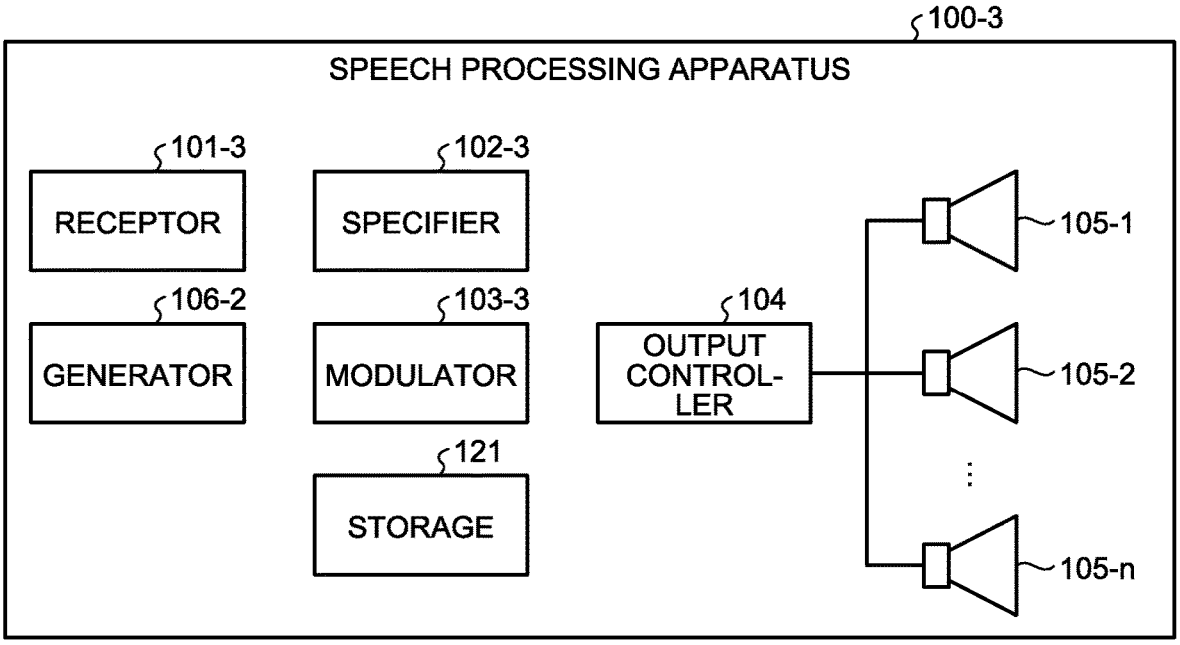
FIG. 12 is a block diagram of a speech processing apparatus according to a third embodiment.

FIG. 12 is a block diagram illustrating an example of a configuration of a speech processing apparatus 100-3 according to the third embodiment. As illustrated in FIG. 12, the speech processing apparatus 100-3 includes a storage 121, a receptor 101-3, a specifier 102-3, a modulator 103-3, an output controller 104, the speakers 105-1 to **105-*n*, and a generator 106-2**.

The third embodiment differs from the second embodiment in functions of the receptor 101-3, the specifier 102-3, and the modulator 103-3. Other configurations and functions are the same as those in FIG. 10, which is a block diagram of the speech processing apparatus 100-2 according to the second embodiment, and are therefore denoted by the same reference symbols and descriptions thereof are omitted.

The receptor 101-3 receives not only text data but also a speech input from a speech input device, such as a microphone. Furthermore, the receptor 101-3 receives a designation of a part of the input speech to be emphasized. For example, the receptor 101-3 receives a depression of a predetermined button by a user as a designation indicating that a speech input after the depression is a part to be emphasized. The receptor 101-3 may receive designations of start and end of an emphasis part as a designation indicating that a speech input from the start to the end is a part to be emphasized. The designation methods are not limited thereto, and any method can be employed as one; as a part to be emphasized in a speech can be determined. The designation of a part of a speech to be emphasized is hereinafter sometimes referred to as "trigger".

The specifier 102-3 further has the function of specifying an emphasis part of a speech on the basis of a received designation (trigger).

The modulator 103-3 performs the modulation processing on an emphasis part of a speech generated by the generator 106-2 or of an input speech.

Figure 13:
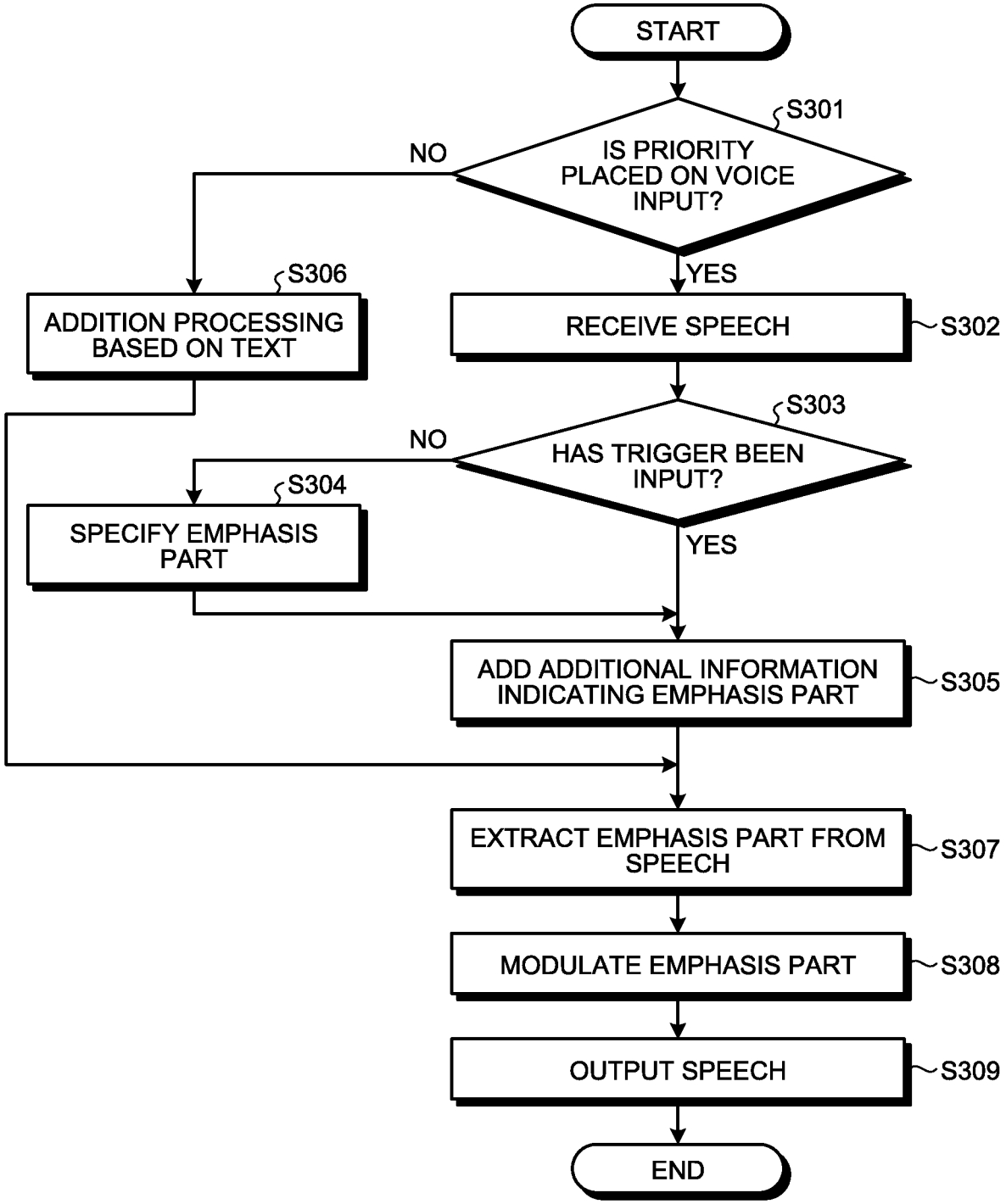
FIG. 13 is a flowchart of the speech output processing according to the third embodiment.

Next, the speech output processing by the speech processing apparatus 100-3 according to the third embodiment configured as described above is described with reference to FIG. 13. FIG. 13 is a flowchart illustrating an example of the speech output processing in the third embodiment.

The receptor 101-3 determines whether priority is placed on speech input (Step S301). Placing priority on speech input is a designation indicating that speech is input and output instead of text data. For example, the receptor 101-3 determines that priority is placed on speech input when a button for designating that priority is placed on speech input has been depressed.

The method of determining whether priority is placed on speech input is not limited thereto. For example, the receptor 101-3 may determine whether priority is placed on speech input by referring to information stored in advance that indicates whether priority is placed on speech input. In the case where no text data is input and only speech is input, a designation and a determination as to whether priority is placed on speech input (Step S301) are not required to be executed. In this case, addition processing (Step S306) based on the text data described later is not necessarily required to be executed.

When priority is placed on speech input (Yes at Step S301), the receptor 101-3 receives an input of speech (Step S302). The specifier 102-3 determines whether a designation (trigger) of a part of the speech to be emphasized has been input (Step S303).

When no trigger has been input (No at Step S303), the specifier 102-3 specifies the emphasis part of the speech (Step S304). For example, the specifier 102-3 collates the input speech with speech data registered in advance, and specifies speech that matches or is similar to the registered speech data as the emphasis part. The specifier 102-3 may specify the emphasis part by collating text data obtained by speech recognition of input speech and data representing a predetermined emphasis part.

When it is determined at Step S303 that a trigger has been input (Yes at Step S303) or after the emphasis part is specified at Step S304, the specifier 102-3 adds additional information indicating the emphasis part to data on the input speech (Step S305). Any method of adding the additional information. Can be employed as long as speech can be determined to be an emphasis part.

When it is determined at Step S301 that no priority is placed on speech input (No at Step S301), the addition processing based on text is executed (Step S306). This processing can be implemented by, for example, processing similar to Step S201 to Step S205 in FIG. 11.

The modulator 103-3 extracts the emphasis part from the generated speech (Step S307). For example, the modulator 103-3 refers to the additional information to extract the emphasis part of the speech. When Step S306 has been executed, the modulator 103-3 extracts the emphasis part by processing similar to Step S206 in FIG. 11.

Step S308 and Step S309 are processing similar to Step S207 and Step S208 in the speech processing apparatus 100-2 according to the second embodiment, and hence descriptions thereof are omitted.

In this manner, the speech processing apparatus according to the third embodiment is configured to specify an emphasis part of input speech by a trigger or the like, modulate at least one of the pitch and phase of the emphasis part of the speech, and output the modulated speech. Consequently, users' attention can be enhanced without changing the intensity of speech signals.

Fourth Embodiment

In the above-mentioned embodiments, the case where speech to be output to a pair of speakers 105 (speaker 105-1 and speaker 105-2) is modulated has been exemplified. A speech processing apparatus according to a fourth embodiment is configured to determine a pair of speakers 105 for modulating speech from among the plurality of speakers 105, and modulate the speech to be output to the determined pair of speakers 105.

Figure 14:
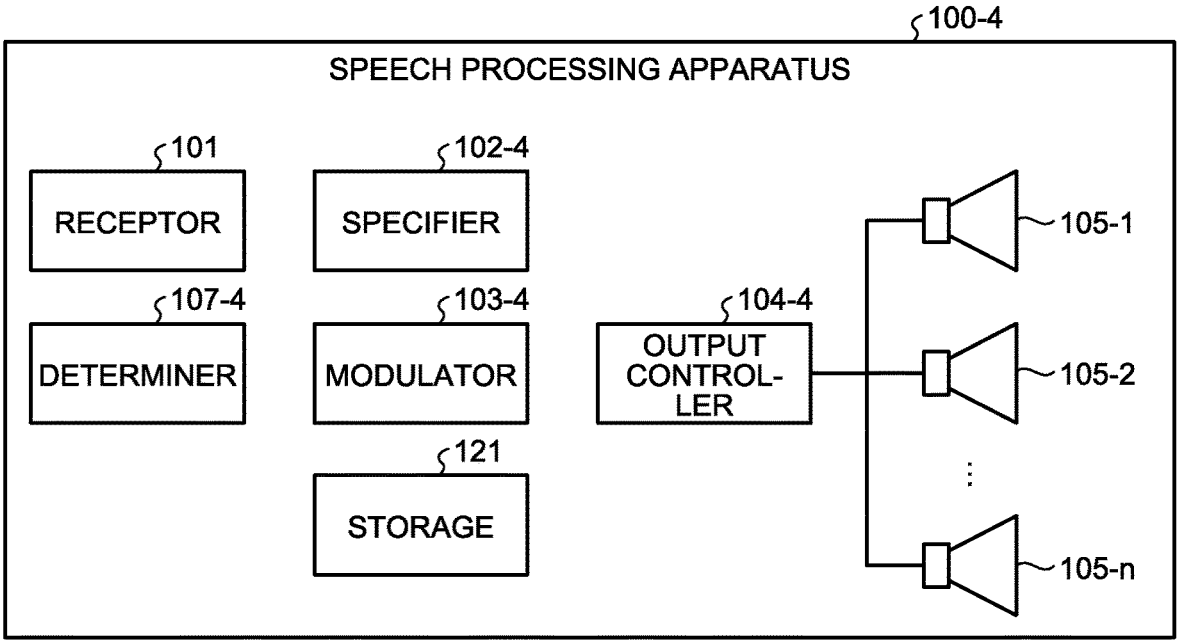
FIG. 14 is a block diagram of a speech processing apparatus according to a fourth embodiment.

FIG. 14 is a block diagram illustrating an example of a configuration of a speech processing apparatus 100-4 according to the fourth embodiment. As illustrated in FIG. 14, the speech processing apparatus 100-4 includes a storage 121, a receptor 101, a specifier 102-4, a modulator 103-4, an output controller 104-4, the speakers 105-1 to **105-*n*, and a determiner 107-4. The storage 121, the receptor 101, and the speakers 105-1 to 105-*n* are the same as those in FIG. 1, which is a block diagram of the speech processing apparatus 100** according to the first embodiment, and are therefore denoted by the same reference symbols and descriptions thereof are omitted.

The speakers 105 may be provided outside the speech processing apparatus 100-4. As described later, the speakers 105 may be installed in an outdoor public space and may be connected to the speech processing apparatus 100-4 via a network or the like. In this case, the speech processing apparatus 100-4 may be configured as, for example, a server apparatus connected to the network. The network may be either of a wireless network or a wired network.

Note that the following description is mainly an example where the first embodiment is modified to constitute the fourth embodiment, but the same modification can be applied to the second and third embodiments.

The determiner 107-4 determines, from among the plurality of speakers 105 (output units), two or more speakers 105 for outputting speech for emphasizing an emphasis part. For example, the determiner 107-4 determines a pair including two speakers 105 (first output unit and second output unit). The determiner 107-4 may determine a plurality of pairs. Each pair may include three or more speakers 105. Some speakers 105 in pairs may be included in different pairs. Specific examples of the method of determining a pair of speakers 105 are described later. The speakers 105 for outputting speech for emphasizing an emphasis part are hereinafter sometimes referred to as "target speakers".

For example, the determiner 107-4 determines the speakers 105 designated by a user as the target speakers from among the speaker 105-1 to the speaker **105-*n*. The method of determining the speakers 105 is not limited to this method. Any method capable of determining target speakers from among the speaker 105-1 to the speaker 105-*n* can be employed. For example, the speakers 105 that are determined in advance for speech to be output may be determined as the target speakers. Target speakers may be determined depending on various kinds of information, such as the season, the date and time, the time, and the ambient conditions of speakers 105**. Examples of the ambient conditions include the presence/absence of objects (such as humans, vehicles, and flying objects), the number of objects, and operating conditions of objects.

The specifier 102-4 differs from the specifier 102 in the first embodiment in that the specifier 102-4 further has the function of specifying a different emphasis part for each pair when speech is output to a plurality of pairs.

The modulator 103-4 differs from the modulator 103 in the first embodiment in that the modulator 103-4 further has the function of modulating emphasis parts different depending on pairs when speech is output to a plurality of pairs.

The output controller 104-4 differs from the output controller 104 in the first embodiment in that the output controller 104-4 further has the function of controlling a speaker 105 to which modulated speech is not output among the speakers 105 to output speech in which an emphasis part is not emphasized.

Figure 15:
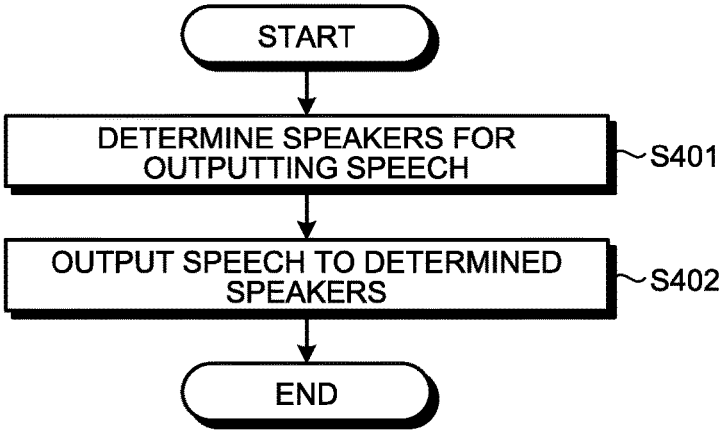
FIG. 15 is a flowchart of the speech output processing according to the fourth embodiment.

Next, the speech output processing by the speech processing apparatus 100-4 according to the fourth embodiment configured as described above is described with reference to FIG. 15. FIG. 15 is a flowchart illustrating an example of the speech output processing in the fourth embodiment.

The determiner 107-4 determines two or more speakers 105 (target speakers) for outputting speech for emphasizing an emphasis part from among the plurality of speakers 105 (Step S401). The determiner 107-4 may further determine a speaker 105 to which unmodulated speech (normal speech) that is not modulated for emphasis is output from among the speakers 105.

After that, speech is output to the determined speakers 105 (Step S402). The processing at Step S402 can be implemented by, for example, processing similar to that in FIG. 9 in the first embodiment. When the method in the fourth embodiment is applied to the second or third embodiment, processing similar to that in FIG. 11 or FIG. 13 is executed at Step S402.

The processing of determining the speakers 105 at Step S401 may be executed at Step S402. For example, when a text is received (at Stein S101 in FIG. 9), the determiner 107-4 may determine the speakers 105 that are determined in accordance with the received text. When an emphasis part is specified (at Step S103 in FIG. 9), the determiner 107-4 may determine the speakers 105 in accordance with the specified emphasis part.

Figure 16:
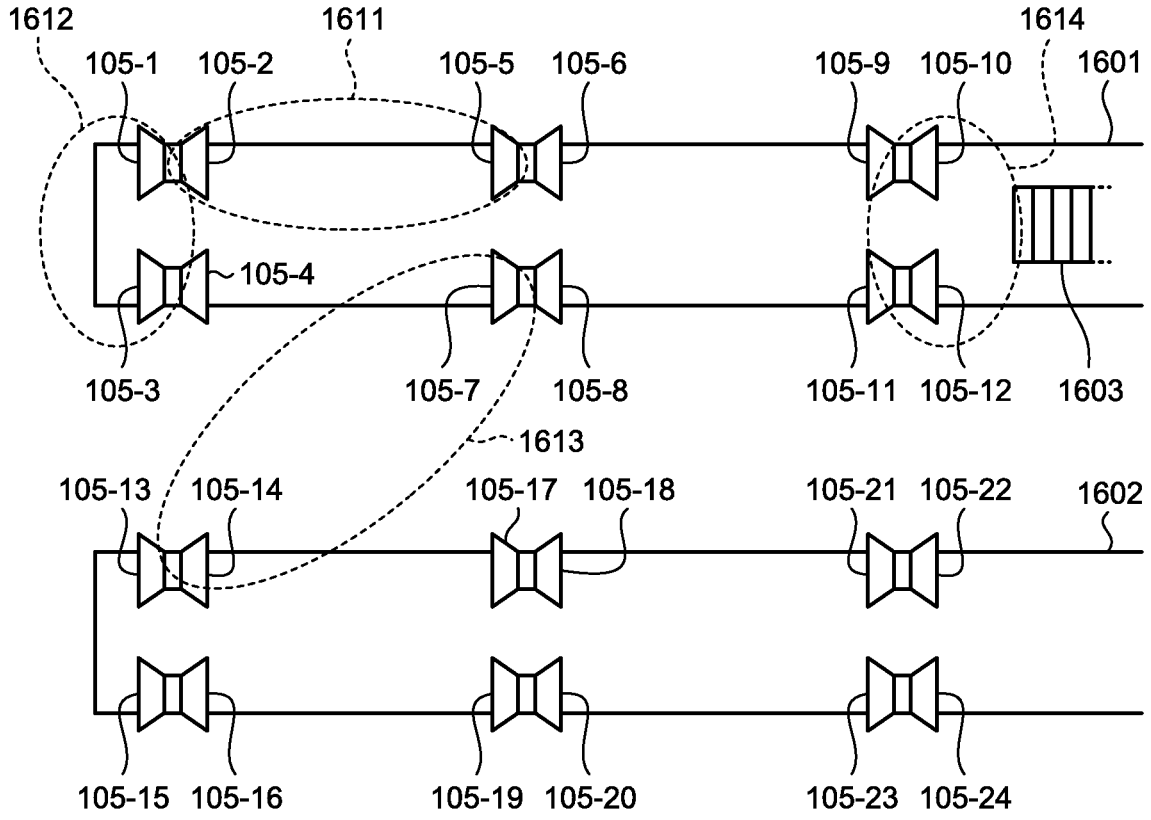
FIG. 16 is a diagram illustrating an example of arrangement of speakers in embodiments.

Now, specific examples of the target speaker determination method are described with reference to FIG. 16 to FIG. 19. FIG. 16 illustrates an example of arrangement of speakers 105 installed on railroad platforms and an example of the determined speakers 105.

As illustrated in FIG. 16, the plurality of speakers 105 are installed on each of two platforms 1601 and 1602. FIG. 16 is an example of arrangement of speakers 105 as observed from above the two platforms 1601 and 1602. Speakers 105-1 to 105-12 are installed on the platform 1601. Speakers 105-13 to 105-24 are installed on the platform 1602.

The determiner 107-4 determines, for example, a pair of speakers 105 installed in a region of an end portion of the platform 1601 among the speakers 105, as the target speakers. In this manner, the determiner 107-4 may determine speakers 105 that are determined in accordance with each region as the target speakers. For example, a region 1611 is a region located near the end portion of the platform 1601 on a side where a vehicle enters the platform 1601. In the case of outputting emphasized speeches to such a region. 1611, the determiner 107-4 determines a pair of the speakers 105-2 and 105-5 for outputting speech in the direction of the region. 1611 as the target speakers. Consequently, for example, the approach of a vehicle can be appropriately notified.

In this case, the speakers 105 installed in a region at a center part of the platform 1601 may be determined as the speakers 105 for outputting speech without any emphasis. The determiner 107-4 may determine the speakers 105 installed in the region at the center part of the platform 1601 as the target speakers, and determine the speakers 105 installed in the other regions as the speakers 105 for outputting speech without any emphasis.

The determiner 107-4 may determine a pair of speakers 105-1 and 105-3 for outputting speech to a region 1612 closer to the end of the platform 1601 as the target speakers. The speakers 105 determined as the target speakers are not required to be installed on the same platform. For example, the determiner 107-4 may determine a pair of speakers 105-7 and 105-14 for outputting speech to a region 1613 between the platforms 1601 and 1602 as the target speakers. If output ranges of speeches overlap with each other, for example, the speakers 105-5 and 105-6 may be determined as the target speakers. Consequently, the emphasized speech can be output to a region including regions directly below the speakers 105-5 and 105-6.

A region 1614 is a region near stairs 1603. The determiner 107-4 may determine a pair of speakers 105-10 and 105-12 for outputting speech to the region 1614 as the target speakers. In this manner, for example, speech to draw attention that the region is crowded because of an obstacle such as the stairs 1603 can be appropriately output.

The determiner 107-4 may determine a speaker 105 that is closer to a target (such as humans) to which emphasized speech is output than the other speakers 105 are as the target speaker. For example, the determiner 107-4 may determine two speakers 105 closest to a subject as the target speakers. The determiner 107-4 may determine a region where a subject is present with a camera, for example, and determine two speakers 105 for outputting speech to the determined region as the target speakers.

When emphasized speeches are to be output from all speakers 105, the determiner 107-4 may determine all speakers 105 as the target speakers.

For example, when the speakers 105 in a plurality of adjacent regions are determined as the target speakers, the modulator 103-4 only needs to modulate speech to be output to each target speaker such that emphasized speech is output to each region. For example, consider the case where emphasized speech is output to a region 1611 and a region including a region directly below a speaker 105-5 and a speaker 105-6. In this case, for example, the modulator 103-4 modulates a modulation target of speech to be output to the speaker 105-2 and the speaker 105-6, but does not modulate a modulation target of speech to be output to the speaker 105-5.

Note that, in the present embodiment, for example, it is not required to separately use male speech and female speech for inbound vehicles and outbound vehicles. In other words, the speech to be output itself is not required to be changed. The modulator 103-4 can output emphasized speech by executing the modulation processing on the same speech.

Figure 17:
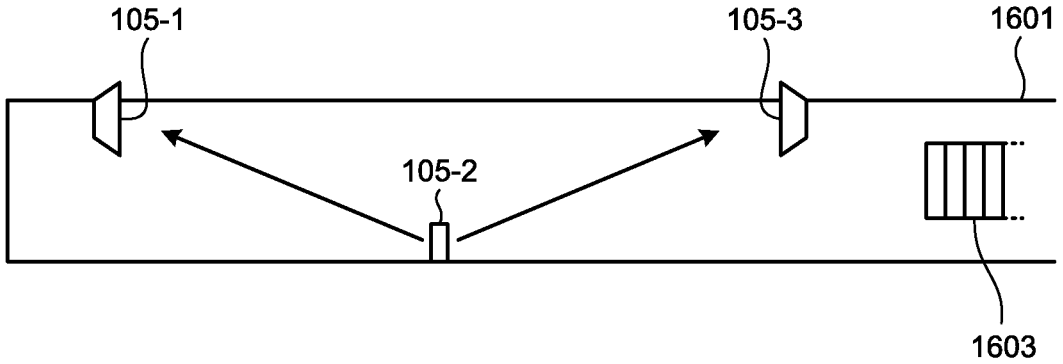
FIG. 17 is a diagram illustrating an example of arrangement of speakers in the embodiments.

The speakers 105 are more preferred to have directivity, but may be omnidirectional speakers. FIG. 17 illustrates another example of arrangement of speakers 105 installed on a railroad platform. As illustrated in FIG. 17, the speakers 105-1 and 105-3 having directivity and a speaker 105-2 having no directivity may be combined.

Figure 18:
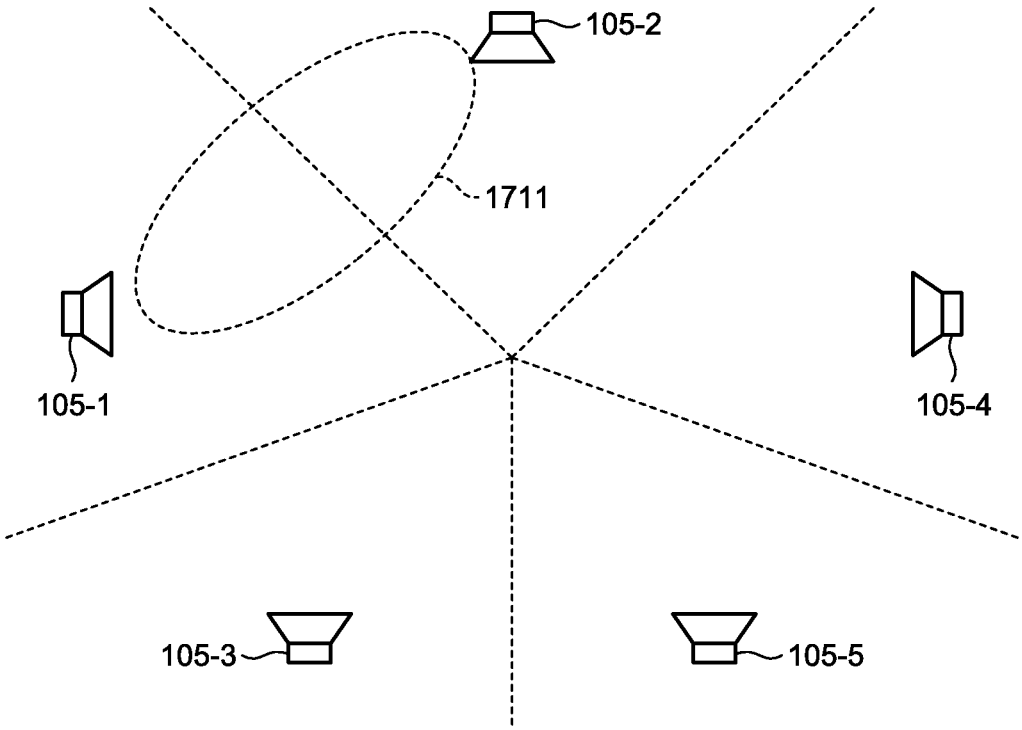
FIG. 18 is a diagram illustrating an example of arrangement of speakers in the embodiments.

FIG. 18 illustrates an example of arrangement of speakers 105 installed in a public space and an example of the determined speakers 105. Examples of the public space include a space, a park, and a ground where outdoor speakers for outputting emergency broadcasting are installed.

FIG. 18 illustrates an example in which five speakers 105-1 to 105-5 are installed in a public space FIG. 18 can be interpreted as a Voronoi diagram having the divided regions in association with the corresponding closest speakers 105.

For example, a region in the vicinity of the middle of one side constituting the Voronoidiagram may be set as a region where an emphasized speech is output. For example, the determiner 107-4 determines two speakers 105 included in two regions in the Voronoi diagram divided by the side corresponding to the set region as the target speakers. For example, when an emphasized speech is to be output to a target within a region 1711 in FIG. 18, the determiner 107-4 determines the speaker 105-1 and the speaker 105-2 as the target speakers. The determiner 107-4 may determine a speaker 105 in a region including a target (such as humans) and a speaker 105 which is in regions outside the region including the target and which is closest to the target among the speakers 105, as the target speakers. The determiner 107-4 may determine two speakers 105 closest to a target as the target speakers irrespective of the regions divided by the Voronoi diagram.

In the case of outputting emphasized speeches to a plurality of adjacent regions, the determiner 107-4 determines target speakers such that emphasized speeches can be output to all of the regions. For example, in the case of outputting emphasized speeches to all regions in FIG. 18, the determiner 107-4 determines all speakers 105-1 to 105-5 as the target speakers. In this case, the modulator 103-4 only needs to modulate speech to be output to each target speaker such that emphasized speech is output to each region.

For example, the modulator 103-4 performs, for each of five pairs including a pair of the speaker 105-1 and the speaker 105-2, a pair of the speaker 105-2 and the speaker 105-4, a pair of the speaker 105-4 and the speaker 105-5, a pair of the speaker 105-5 and the speaker 105-3, and a pair of the speaker 105-3 and the speaker 105-1, the modulation processing such that modulation targets are different between the speakers 105 included in each pair.

Note that, for example, speeches to be output to the speakers 105-1, 105-4, and 105-3 are similarly modulated and speeches to be output to the speakers 105-2 and 105-5 are not modulated. In this case, the last one of the five pairs cannot be modulated to have different modulation targets. In such a case, for example, the modulator 103-4 performs the modulation processing such that the degree of modulation (modulation intensity) differs among the pairs. For example, when the modulator 103-4 gradually changes the modulation intensity of each pair, the modulator 103-4 can execute the modulation processing such that modulation targets are different for ail of the five pairs.

A part of speakers 105 may be replaced with an output unit such as a loudspeaker, and a modulation target may be modulated between the loudspeaker and the speaker 105. For example, the speech processing apparatus 100-4 measures a distance between the loudspeaker and the speaker 105 in advance. The distance can be measured by any method such as methods using a laser, the Doppler effect, and the GPS. The determiner 107-4 determines a speaker 105 to be paired with the loudspeaker by referring to the measured distance and the arrangement of speakers 105. The modulator 103-4 modulates, for speech input to the loudspeaker, a modulation target of an emphasis part of at least one of speech to be output from the loudspeaker and speech to be output from the speaker 105 such that the modulation targets are different between the emphasis part of the speech to be output from the loudspeaker and the emphasis part of the speech to be output from the speaker 105.

Figure 19:
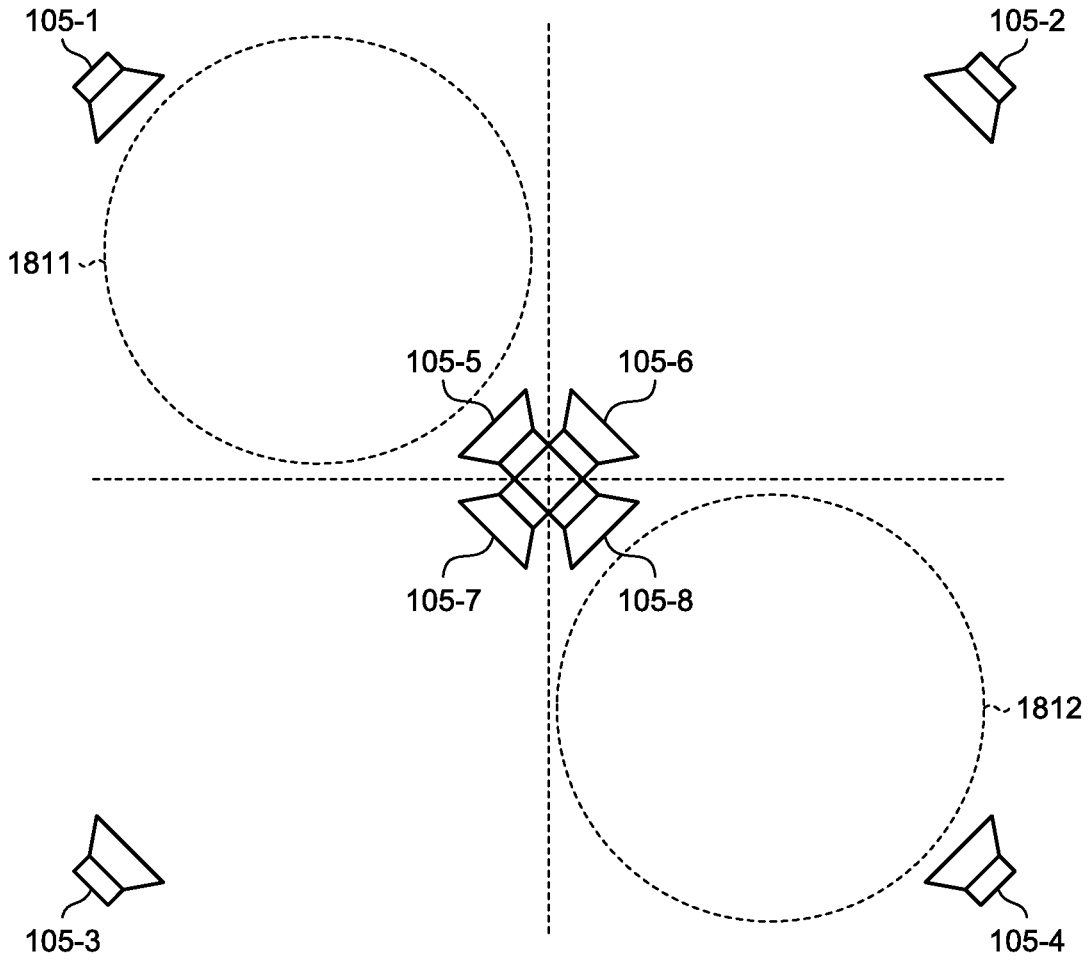
FIG. 19 is a diagram illustrating an example of arrangement of speakers in the embodiments.

FIG. 19 illustrates an example of arrangement of speakers 105 for outputting speech by speech output applications and an example of the determined speakers 105. Examples of the speech output applications include a reading application for reading contents of books (text data) and outputting the contents by speech. Applicable applications are not limited thereto.

The entire region where speech is output is divided into four regions depending on pairs of speakers 105. In FIG. 19, the regions correspond to four regions divided by vertical and horizontal broken lines. Different parts may be emphasized depending on the divided regions. For example, the specifier 102-4 specifies an emphasis part (first emphasis part) of speech to be output to a region 1811 and an emphasis part (second emphasis part) of speech to be output to a region 1812. The determiner 107-4 determines target speakers (first output unit and second output unit) for outputting speech for emphasizing the first emphasis part, and determines target, speakers (third output unit and fourth output unit) for outputting speech for emphasizing the second emphasis part.

For example, the specifier 102-4 specifies a region where an emphasis part is output and the emphasis part by referring to information stored in the storage 121 in which a region where emphasized speech is output, and an emphasis part are defined. The determiner 107-4 determines the speakers 105 that are determined for the specified region as the target speakers. The speech output application may have a function of designating a region and an emphasis part during the output of speech, and the specifier 102-4 may specify the region and the emphasis part designated via the speech output application.

The configuration described above enables, for example, speeches of different characters in a story to be emphasized and output for each region. As a result, for example, a sense of realism of a story can be further enhanced. The specifier 102-4 may specify different regions and different emphasis parts in accordance with at least one of the place where the speech output application is executed and the number of outputs of speech. Consequently, for example, speech can be output while keeping a user from being bored even for contents of the same book.

In this manner, the speech processing apparatus according to the fourth embodiment is configured to determine, from among a plurality of speakers, speakers for outputting speech in which an emphasis part is modulated, and modulate speech to be output to the determined speakers. Consequently, for example, emphasized speech can be appropriately output to a desired place. For example, the users present in a particular place are caused to efficiently pay attention.

As described above, according to the first to fourth embodiments, speech is output while at least one of the pitch and phase of the speech is modulated, and hence users' attention can be raised without the intensity of speech signals is not changed.

Figure 20:
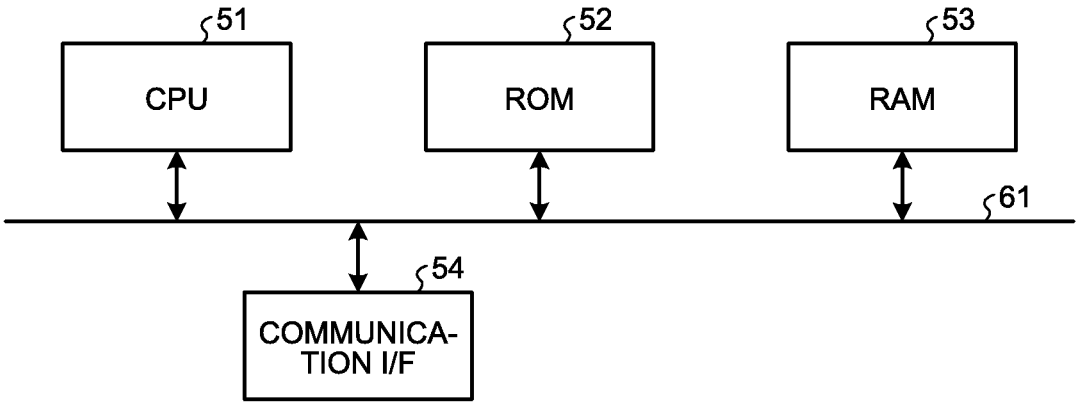
FIG. 20 is a hardware configuration diagram of the speech processing apparatus according to the embodiments.

Next, a hardware configuration of the speech processing apparatuses according to the first to fourth embodiments is described with reference to FIG. 20. FIG. 20 is an explanatory diagram illustrating a hardware configuration example of the speech processing apparatuses according to the first to fourth embodiments.

The speech processing apparatuses according to the first to fourth embodiments include a control device such as a central processing unit (CPU) 51, a storage device such as a read only memory (ROM) 52 and a random access memory (RAM) 53, a communication I/F 54 configured to perform communication through connection to a network, and a bus 61 connecting each unit.

The speech processing apparatuses according to the first to fourth embodiments are each a computer or an embedded system, and may be either of an apparatus constructed by a single personal computer or microcomputer or a system in which a plurality of apparatuses are connected via a network. The computer in the present embodiment is not limited to a personal computer, but includes an arithmetic processing unit and a microcomputer included in an information processing device. The computer in the present embodiment refers collectively to a device and an apparatus capable of implementing the functions in the present embodiment by computer programs.

Computer programs executed by the speech processing apparatuses according to the first to fourth embodiments are provided by being incorporated in the ROM 52 or the like in advance.

Computer programs executed by the speech processing apparatuses according to the first to fourth embodiments may be recorded in a computer-readable recording medium, such as a compact disc read only memory (CD-ROM), a flexible dish (FD), a compact disc recordable (CD-R), a digital versatile disc (DVD), a USE, flash memory, an SD card, and an electrically erasable programmable read-only memory (EEPROM), in an installable format or an executable format, and provided as a computer program product.

Furthermore, computer programs executed by the speech processing apparatuses according to the first to fourth embodiments may be stored on a computer connected to a network such as the Internet, and provided by being downloaded via the network. Computer programs executed by the speech processing apparatuses according to the first to fourth embodiments may be provided or distributed via a network such as the Internet.

Computer programs executed by the speech processing apparatuses according to the first to fourth embodiments can cause a computer to function as each unit in the speech processing apparatus described above. This computer can read the computer programs by the CPU 51 from a computer-readable storage medium onto a main storage device and execute the read computer programs.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fail within the scope and spirit of the inventions.

What is claimed is:

1. A speech processing apparatus, comprising:

a receiver implemented by one or more hardware processors and configured to receive a trigger that is specified by a user and indicates a portion of an input speech to be emphasized;

an emphasis specification system implemented by the one or more hardware processors and configured to specify a portion of speech to emphasize during output of a speech based on the trigger;

a determination system implemented by the one or more hardware processors and configured to determine, from among a plurality of speaker devices, a first speaker device and a second speaker device for outputting the portion of speech to be emphasized;

a modulator configured to modulate an emphasis portion of at least one of a first speech to be output to the first speaker device and a second speech to be output to the second speaker device such that at least one of a pitch and a phase is different between the emphasis portion of the first speech and the emphasis portion of the second speech; and an output controller configured to control the first speaker device to output the first speech, control the second speaker device to output the second speech, and control speaker devices other than the first speaker and the second speaker among the plurality of speaker devices to output speech in which a portion of speech to emphasize is not modulated, wherein:

the emphasis specification system is further configured to specify a first portion of speech to emphasize and a second portion of speech to emphasize of the speech to be output, the determination system is further configured to determine, from among the plurality of speaker devices, the first speaker device and the second speaker device for outputting the first portion of speech, and a third speaker device and a fourth speaker device for outputting the second portion of speech, and the modulator is further configured to modulate a first emphasis portion of at least one of the first speech and the second speech such that at least one of a pitch and a phase is different between the first emphasis portion of the first speech and the first emphasis portion of the second speech, and modulate a second emphasis portion of at least one of a third speech to be output to a third speaker device and a fourth speech to be output to a fourth speaker device such that at least one of a pitch and a phase is different between the second emphasis portion of the third speech and the second emphasis portion of the fourth speech.

2. The speech processing apparatus according to claim 1, wherein the determination system is further configured to determine, as the first speaker device and the second speaker device, from among the plurality of speaker devices, speaker devices that are closer to a target to which the speech including the emphasis portion is output than other speaker devices included in the plurality of speaker devices.

3. The speech processing apparatus according to claim 1, wherein the determination system is further configured to determine, as the first speaker device and the second speaker device, from among the plurality of speaker devices, speaker devices that are determined in accordance with a region where speech including the emphasis portion is output.

4. The speech processing apparatus according to claim 1, wherein the emphasis specification system is further configured to specify the portion of speech to emphasize based on input text data, and the modulator is further configured to generate the first speech and the second speech that correspond to the text data, the first speech and the second speech being obtained by modulating the emphasis portion of at least one of the first speech and the second speech such that at least one of the pitch and the phase of the emphasis portion is different between the emphasis portion of the first speech and the emphasis portion of the second speech.

5. The speech processing apparatus according to claim 1, further comprising a text-to-speech generator implemented by one or more hardware processors and configured to generate the first speech and the second speech based on input text data, wherein the emphasis specification system is further configured to specify the portion of speech to emphasize based on the text data, and the modulator is further configured to modulate the emphasis portion of at least one of the first speech and the second speech such that at least one of the pitch and the phase is different between the emphasis portion of the generated first speech and the emphasis portion of the generated second speech.

6. The speech processing apparatus according to claim 1, wherein the modulator is further configured to modulate a phase of the emphasis portion of at least one of the first speech and the second speech such that a difference between the phase of the emphasis portion of the first speech and the phase of the emphasis portion of the second speech is 60° or more and 180° or less.

7. The speech processing apparatus according to claim 1, wherein the modulator is further configured to modulate a pitch of the emphasis portion of at least one of the first speech and the second speech such that a difference between a frequency of the emphasis portion of the first speech and a frequency of the emphasis portion of the second speech is 100 hertz or more.

8. The speech processing apparatus according to claim 1, wherein the modulator is further configured to modulate a phase of the emphasis portion of at least one of the first speech and the second speech by reversing a polarity of a signal input to the first speaker device or the second speaker device.

9. A speech processing method, comprising:

receiving a trigger that is specified by a user and indicates a portion of an input speech to be emphasized;

specifying an emphasis portion of a speech to be output based on the trigger;

determining, from among a plurality of speaker devices, a first speaker device and a second speaker device for outputting the speech with the emphasis portion;

modulating an emphasis portion of at least one of a first speech to be output to the first speaker device and a second speech to be output to the second speaker device such that at least one of a pitch and a phase is different between the emphasis portion of the first speech and the emphasis portion of the second speech; and controlling the first speaker device to output the first speech, control the second speaker device to output the second speech, and control speaker devices other than the first speaker and the second speaker among the plurality of speaker devices to output speech in which a portion of speech to emphasize is not modulated, wherein specifying the emphasis portion of the speech further comprises specifying a first portion of speech to emphasize and a second portion of speech to emphasize of the speech to be output, determining the first speaker device and the second speaker device further comprises determining, from among the plurality of speaker devices, the first speaker device and the second speaker device for outputting the first portion of speech, and a third speaker device and a fourth speaker device for outputting the second portion of speech, and modulating the emphasis portion comprises modulating a first emphasis portion of at least one of the first speech and the second speech such that at least one of a pitch and a phase is different between the first emphasis portion of the first speech and the first emphasis portion of the second speech, and modulating a second emphasis portion of at least one of a third speech to be output to a third speaker device and a fourth speech to be output to a fourth speaker device such that at least one of a pitch and a phase is different between the second emphasis portion of the third speech and the second emphasis portion of the fourth speech.

10. A computer program product having a non-transitory computer readable medium including programmed instructions, wherein the instructions, when executed by a computer, cause the computer to perform operations comprising:

receiving a trigger that is specified by a user and indicates a portion of an input speech to be emphasized;

specifying an emphasis portion of a speech to be output based on the trigger;

determining, from among a plurality of speaker devices, a first speaker device and a second speaker device for outputting the speech with the emphasis portion;

modulating the emphasis portion of at least one of a first speech to be output to the first speaker device and a second speech to be output to the second speaker device such that at least one of a pitch and a phase is different between the emphasis portion of the first speech and the emphasis portion of the second speech; and controlling the first speaker device to output the first speech, control the second speaker device to output the second speech, and control speaker devices other than the first speaker and the second speaker among the plurality of speaker devices to output speech in which a portion of speech to emphasize is not modulated, wherein specifying the emphasis portion of the speech further comprises specifying a first portion of speech to emphasize and a second portion of speech to emphasize of the speech to be output, determining the first speaker device and the second speaker device further comprises determining, from among the plurality of speaker devices, the first speaker device and the second speaker device for outputting the first portion of speech, and a third speaker device and a fourth speaker device for outputting the second portion of speech, and modulating the emphasis portion comprises modulating a first emphasis portion of at least one of the first speech and the second speech such that at least one of a pitch and a phase is different between the first emphasis portion of the first speech and the first emphasis portion of the second speech, and modulating a second emphasis portion of at least one of a third speech to be output to a third speaker device and a fourth speech to be output to a fourth speaker device such that at least one of a pitch and a phase is different between the second emphasis portion of the third speech and the second emphasis portion of the fourth speech.

* * * * *